US005271326A

United States Patent [19]

Ebina

[11] Patent Number: 5,271,326

[45] Date of Patent: Dec. 21, 1993

[54] CYLINDER CLEANING MECHANISM FOR A PRINTING PRESS

[75] Inventor: Toshihiko Ebina, Toride, Japan

[73] Assignee: Komori Corporation, Tokyo, Japan

[21] Appl. No.: 921,358

[22] Filed: Jul. 27, 1992

Related U.S. Application Data

[63] Continuation of Ser. No. 657,673, Feb. 19, 1991, abandoned.

[30] Foreign Application Priority Data

Mar. 5, 1990 [JP] Japan ..... 2-21408[U]

[51] Int. Cl.[5] ..... F41L 41/00

[52] U.S. Cl. ..... 101/425; 101/423; 101/167

[58] Field of Search ..... 101/423, 425, 167, 168, 101/169, 114, 123, 124; 15/256.51

[56] References Cited

U.S. PATENT DOCUMENTS

| | | | |
|---|---|---|---|
| 3,766,853 | 10/1973 | Gallagher et al. | 101/425 X |
| 4,344,361 | 8/1982 | MacPhee et al. | 16/256.51 X |
| 4,537,130 | 8/1985 | Theilacker | 101/425 |
| 4,651,644 | 3/1987 | Kaempfe et al. | 101/423 |
| 4,920,880 | 5/1990 | Hara et al. | 101/425 |
| 4,922,821 | 5/1990 | Nozaka et al. | 101/425 |
| 4,953,463 | 9/1990 | Hara | 101/425 |
| 5,012,739 | 5/1991 | Loos et al. | 101/425 |
| 5,105,740 | 4/1992 | Loos et al. | 101/425 |

FOREIGN PATENT DOCUMENTS 0011329 1/1990 Japan ..... 101/425

*Primary Examiner*—Edgar S. Burr
*Assistant Examiner*—Christopher A. Bennett
*Attorney, Agent, or Firm*—Abelman Frayne & Schwab

[57] ABSTRACT

The present invention provides an improved cylinder cleaning mechanism for cleaning the circumference of a cylinder of a printing press. The cylinder cleaning mechanism comprises, as principal components, a cylinder cleaning unit having a pressure blade for pressing a cleaning cloth against the circumference of the cylinder, and a cylinder cleaning unit operating mechanism comprising a fluid-operated actuator for shifting the cylinder cleaning unit between a cleaning position where the cleaning cloth is pressed against the circumference of the cylinder with the pressure blade and a standby position where the cylinder cleaning unit is separated far away from the circumference of the cylinder, and a mechanism for transmitting the action of the fluid-operated actuator to the cylinder cleaning unit. The fluid-operated actuator is used both for shifting the cylinder cleaning unit between the cleaning position and the standby position and for biasing the cylinder cleaning unit toward the circumference of the cylinder so that the cleaning cloth is pressed properly against the circumference of the cylinder with the pressure blade.

2 Claims, 10 Drawing Sheets

CYLINDER CLEANING MECHANISM FOR A PRINTING PRESS

This application is a continuation of application Ser. No. 07/657,673, filed Feb. 19, 1991 now abandoned.

BACKGROUND OF THE INVENTION

1. Field of the Invention

The present invention relates to a cylinder cleaning mechanism for cleaning a cylinder of a printing press.

2. Description of the Prior Art

A printing press, such as a sheet-fed printing press or a rotary printing press, is provided with a cylinder cleaning mechanism having a cylinder cleaning unit employing a cleaning cloth for cleaning the circumference of the cylinder between successive printing cycles to prevent smearing printing sheets with an ink adhering to the circumference of the impression cylinder or the blanket cylinder. The cleaning cloth is wound at a predetermined rate so that a new portion of the cleaning cloth is pressed always against the circumference of the cylinder so that the circumference of the cylinder can perfectly be cleaned.

A conventional cylinder cleaning mechanism for cleaning the impression cylinder of a printing press will be described with reference to FIG. 7 to 11. There are shown a cylinder cleaning unit 8, side plates 2, an intermediate cylinder 3, an impression cylinder 4 to be cleaned by the cylinder cleaning unit 8, a recess 4a formed in the circumference of the impression cylinder 4, gripping fingers 6a, a gripper shaft 6b fixedly holding the gripping fingers 6a and capable of rocking to hold the edge of a printing sheet on a portion of the circumference of the impression cylinder 4 near the front edge 4b of the recess 4a with the gripping fingers 6a, a cleaning cloth 20, a pressure blade 10 having a front frame 10a and a rear frame 10b, for pressing the cleaning cloth 20 through a pressure pad 12 against the circumference of the impression cylinder 4, a cleaning cloth feed roller 14, a cleaning cloth winding roller 16, a guide bar 18 for guiding the cleaning cloth 20, a main frame 22 of the printing press, a rotary shaft 24 supporting the cylinder cleaning unit 8, bearings supporting the rotary shaft 24 for rotation on the main frame 22, a lever 26 attached to a rotary shaft 36 supported on bearings 36b to turn the cylinder cleaning unit 8 on the rotary shaft 24, a cam roller 30 supported on the lever 26 by a pin 28, a cam 50 engaging the cam roller 30 to turn the lever 26 in synchronism with the motion of the gripping fingers 6a, fixed to the intermediate cylinder 3 with bolts 52 and having a high cam section 50a and a low cam section 50b, a link 34 having one end joined to the lever 26 by a pin 32 and the other end joined to the side plate 2 of the cylinder cleaning unit 8 by a pin 38, a compression spring 40 having one end 44 joined to one end of the lever 26 by a pin 48 and the other end contiguous with a spring seal 46 mounted on a rod 42 to compress the compression spring 40, and a pneumatic actuator 74 having one end fixed with a bolt 84 to a bracket 86 fixed to the main frame 22 and the other end connected to the lever 26 to shift the cylinder cleaning unit 8 between a cleaning position and an escape position.

The pneumatic actuator 74 has a piston rod 76, and a connecting member 78 attached to the extremity of the piston rod 76 and provided with a slot 80 receiving a pin 82 fixed to the lever 26 therein to allow the lever 26 to swing so that the lever 26 may not interfere with the gripping fingers 6a. The cylinder cleaning unit 8 is retracted from its cleaning position to avoid the interference of the cylinder cleaning unit 8 with the gripping fingers 6a, and then the cylinder cleaning unit 8 is returned to its cleaning position after the gripping fingers 6a have passed a position corresponding to the cleaning position. A gear 58 is mounted on a one-way clutch 60 attached to one end of the shaft of the cleaning cloth winding roller 16, and a segment gear 62 is fixed to the main frame 22 with bolts 64 and 66 so as to engage the gear 58. Every time the cylinder cleaning unit 8 is turned on the rotary shaft 24 between the cleaning position and the escape position, the gear 58 rolls along the segment gear 62 to turn the cleaning cloth winding roller 16 through the one-way clutch 60 in one direction to wind up the cleaning cloth 20 by a predetermined length.

The operation of the cylinder cleaning unit 8 will be described hereinafter. Referring to FIG. 7 showing a state in which the recess 4a of the impression cylinder 4 has almost arrived at a position directly below the pressure blade 10, the cam roller 30 attached to one end of the lever 26 is on the low cam section 50b of the cam 50 and hence the cylinder cleaning unit 8 is at the cleaning position with the center of the cleaning cloth winding roller 16 at a position A. In this state, the cleaning cloth 20 is pressed against the circumference of the impression cylinder 4 through the pressure pad 12 by the pressure blade 10 to clean the circumference of the impression cylinder 4.

Upon the arrival of the front edge of the recess 4a at the position directly below the pressure blade 10, the cam roller 30 engages the high cam section 50a of the cam 50 to withdraw the cylinder cleaning unit 8 from the cleaning position and, consequently, the lever 26 is turned clockwise to turn the cylinder cleaning unit 8 on the rotary shaft 24 in a counterclockwise direction through the link 34, so that the center of the cleaning cloth winding roller 16 is shifted to a position B as shown in FIG. 8. While the center of the cleaning cloth winding roller 16 is being shifted from the position A to the position B, the gear 58 engaging the segment gear 62 is rotated clockwise. The rotation of the gear 58 is transmitted through the one-way clutch 60 to the cleaning cloth winding roller 16 to wind up the cleaning cloth 20 by a predetermined length. While the cylinder cleaning unit 8 is being withdrawn from the cleaning position, the pin 82 attached to the lever 26 is able to move in the slot 80 of the connecting member 78 and, therefore, the withdrawal of the cylinder cleaning unit 8 from the cleaning position to avoid the interference of the cylinder cleaning unit 8 with the gripping fingers 6a and the advancement of the cylinder cleaning unit 8 to the cleaning position are not obstructed at all by the pneumatic actuator 74.

As the intermediate cylinder 3 and the impression cylinder 4 rotate further from the position shown in FIG. 8 and the high cam section 50a of the cam 50 passes the cam roller 30, the lever 26 is turned counterclockwise by the compression spring 40 to turn the cylinder cleaning unit 8 clockwise on the rotary shaft 24 to the cleaning position, in which the center of the cleaning cloth winding roller 16 is located at the point A. Although the gear 58 engaging the segment gear 62 is rotated counterclockwise while the cylinder cleaning unit 8 is being turned clockwise, the counterclockwise rotation of the gear 58 is not transmitted to the cleaning cloth winding roller 16. Thus, the cleaning cloth 20 is wound by the predetermined length once every printing cycle, so that the circumference of the impression cylinder 4 is cleaned always with a new portion of the cleaning cloth 20.

After the completion of the cleaning operation or in replacing the used cleaning cloth with a new one, the lever 26 is turned clockwise against the pressure of the compression spring 40 by the pneumatic actuator 74 to turn the cylinder cleaning unit 8 counterclockwise on the rotary shaft 24 beyond the escape position to a standby position, in which the center of the cleaning cloth winding roller 16 is at a point C as shown in FIG. 9.

After the used cleaning cloth 20 has been replaced with a new one or when the cleaning operation is required again, the piston rod 76 of the pneumatic actuator 74 is retracted to allow the lever 26 to be turned counterclockwise by the pressure of the compression spring 40 to shift the cylinder cleaning unit 8 from the standby position to the cleaning position as shown in FIG. 7.

Since the pressure of the compression spring 40 pressing the pressure blade 10 through the cleaning cloth 20 against the circumference of the impression cylinder 4 is not adjustable, in some cases, the cleaning cloth 20 cannot be pressed against the circumference of the impression cylinder 4 at an appropriate pressure and hence the circumference of the impression cylinder 4 cannot perfectly be cleaned. The employment of the compression spring 40 and the pneumatic actuator 74 respectively for pressing the pressure blade 10 against the circumference of the impression cylinder 4 and turning the cylinder cleaning unit 8 to the standby position increases the number of component parts and needs additional space for those components.

SUMMARY OF THE INVENTION

Accordingly, the present invention is directed to the provision of an improved cylinder cleaning mechanism for cleaning the cylinder of a printing press, employing a single actuator both for pressing cleaning means against the circumference of the cylinder to clean the circumference of the cylinder and for shifting a cylinder cleaning unit between a cleaning position and a standby position.

In one aspect of the present invention, a cylinder cleaning mechanism comprises a cylinder cleaning unit comprising a cleaning cloth feed roller for feeding a cleaning cloth, a cleaning cloth winding roller for winding the used cleaning cloth, a pressure blade having cleaning edges and an elastic wiping portion and capable of pressing the cleaning cloth extended between the cleaning cloth feed roller and the cleaning cloth winding roller against the circumference of the cylinder, cleaning cloth winding means for driving the cleaning cloth winding roller to wind up the used portion of the cleaning cloth by a predetermined length at at time, and a fluid-operated actuator both for biasing the cleaning unit toward the cylinder to press the cleaning cloth against the circumference of the cylinder and for moving the cylinder cleaning unit away from the cylinder.

The ink smearing the circumference of the cylinder is scraped off and wiped off perfectly by the cleaning cloth pressed by the pressure blade having the edges and the elastic wiping portion. The pressure applied to the cylinder cleaning unit by the fluid-operated actuator to press the cleaning cloth against the circumference of the cylinder is adjustable so that the cleaning cloth is pressed securely against the circumference of the cylinder for perfect cleaning. The use of the fluid-operated actuator for pressing the cleaning cloth against the circumference of the cylinder and for shifting the cleaning unit relative the to cylinder enables the cylinder cleaning device to be installed in a relatively small space.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENT

Figure 1:
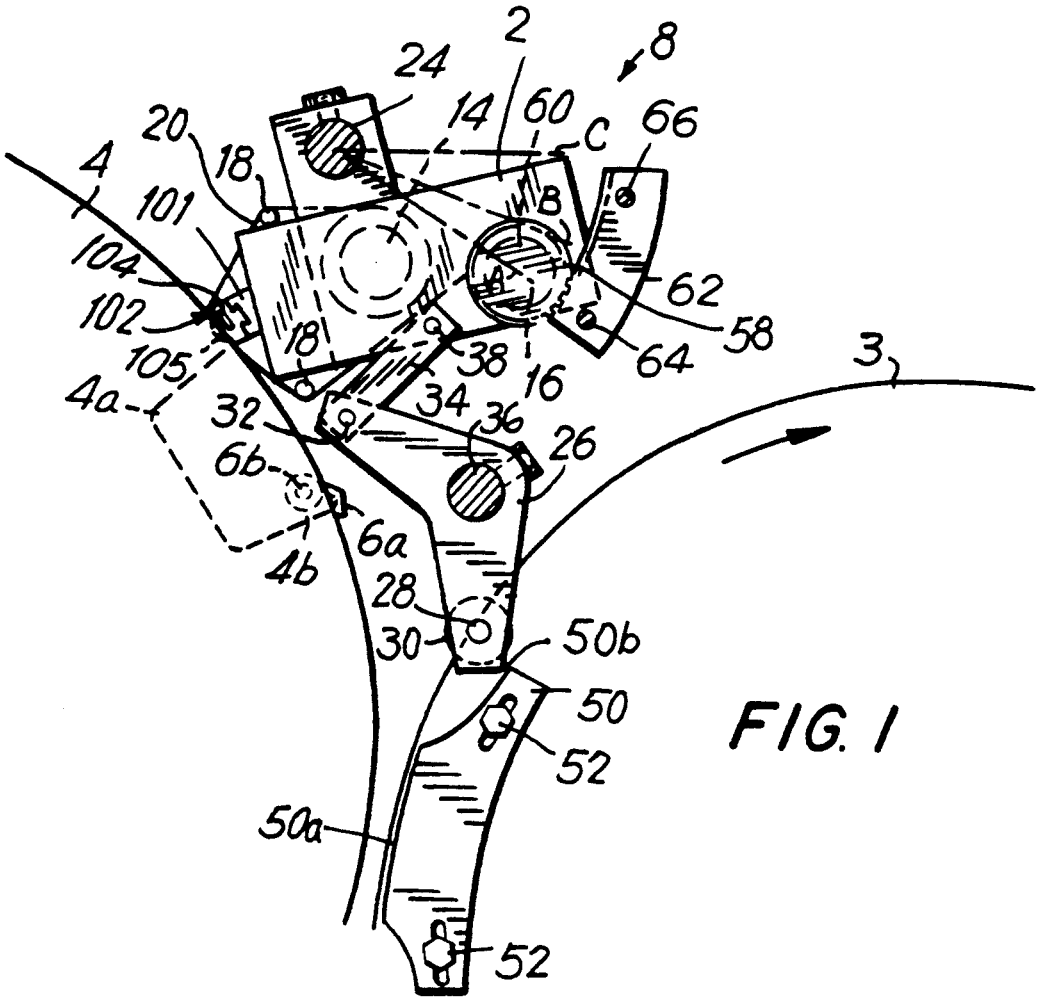
FIG. 1 is a side elevation of a cylinder cleaning mechanism in a preferred embodiment according to the present invention as viewed from one side thereof.

A cylinder cleaning mechanism in a preferred embodiment according to the present invention will be described hereinafter with reference to FIGS. 1 to 6, in which parts like or corresponding to those previously described with reference to FIGS. 7 to 11 are denoted by the same reference characters and the description thereof will be omitted to avoid duplication.

Referring to FIGS. 1 to 4, the cylinder cleaning mechanism comprises, as principal components, a cylinder cleaning unit 8 comprising side plates 2 fixedly held on a rotary shaft 24 journaled on the frame 22 of the printing press, a pressure blade 102 for pressing a cleaning cloth 20 against the circumference of the impression cylinder 4, a holder 101 holding the pressure blade 102 and fixed to the side plates 2, a cleaning cloth feed roller 14 supported for rotation on the side plates 2 and a cleaning cloth winding roller 16 supported for rotation on the side plates 2, and a cylinder cleaning unit operating mechanism comprising a first lever 26 interlocked at its one end with the cylinder cleaning unit 8 by a link 34, fixed to one end of a rotary shaft 36 journaled on the frame 22 of the printing press, and provided at the other end with a cam roller 30, a plate cam 50 having a high cam section 50*a* and a low cam section 50*b* and fixed to the intermediate cylinder 3, a second lever 106 fixed to the other end of the rotary shaft 36, and a pneumatic actuator 107 pivotally supported at its one end on the frame 22 of the printing press and having a piston rod 108 having an extremity pivotally joined to one end of the second lever 106.

Figure 2:
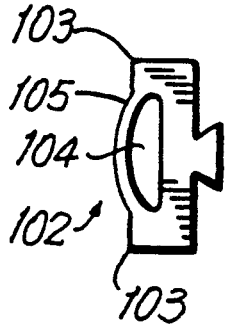
FIG. 2 is a side elevation of a pressure blade employed in the cylinder cleaning mechanism of FIG. 1.

As shown in FIG. 2, the pressure blade 102 has edges 103 with which the cleaning cloth 20 is pressed against the circumference of the impression cylinder 4 so as to scrape off matters smearing the circumference of the impression cylinder 4, and an elastic wiping portion 105 for elastically pressing the cleaning cloth 20 against the circumference of the impression cylinder 4 to wipe off the matters smearing the circumference of the impression cylinder 4.

Figure 3:
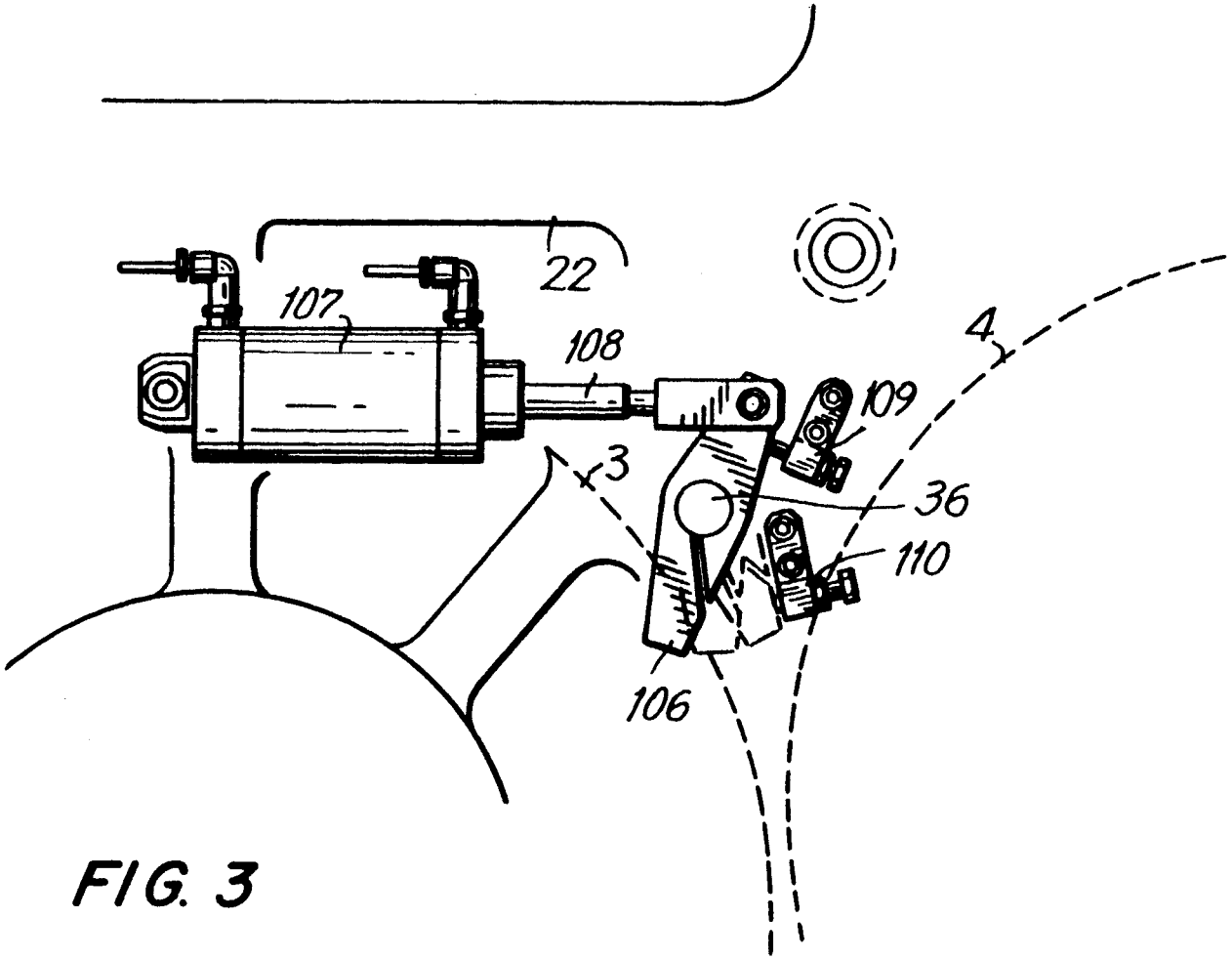
FIG. 3 is a side elevation of the cylinder cleaning mechanism of FIG. 1 as viewed from the other side thereof.
Figure 4:
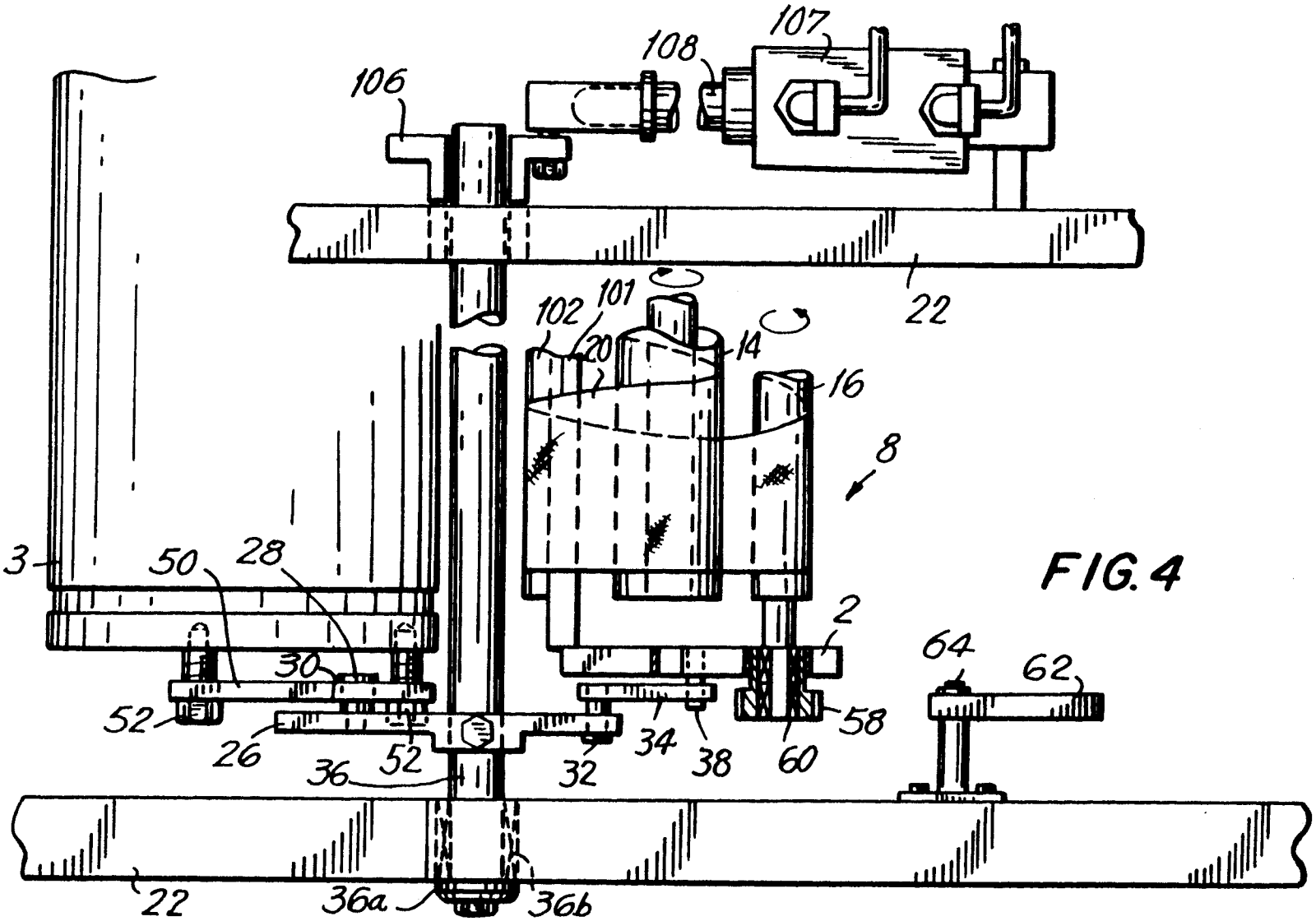
FIG. 4 is a revolved plan view of the cylinder cleaning mechanism of FIG. 1.

When the piston rod 108 of the pneumatic actuator 107 is projected, the cylinder cleaning unit 8 is turned on the rotary shaft 24 through the second lever 106, the rotary shaft 36, the first lever 26 and the link 34 to a cleaning position, at which the pressure blade 102 presses the cleaning cloth 20 against the circumference of the impression cylinder 4 to clean the circumference of the impression cylinder. As shown in FIg. 3, adjustable stoppers 109 and 110 are provided on the frame 22 of the printing press to limit the clockwise turning and counterclockwise turning, respectively, of the second lever 106. The effective pressure acting on the cleaning cloth 20 can be adjusted by adjusting the limit of clockwise turning of the second lever 106 by means of the adjustable stopper 109. When the piston rod 108 of the pneumatic actuator 107 is retracted, the cylinder cleaning unit 8 is retracted from the cleaning position to a standby position.

Figure 5:
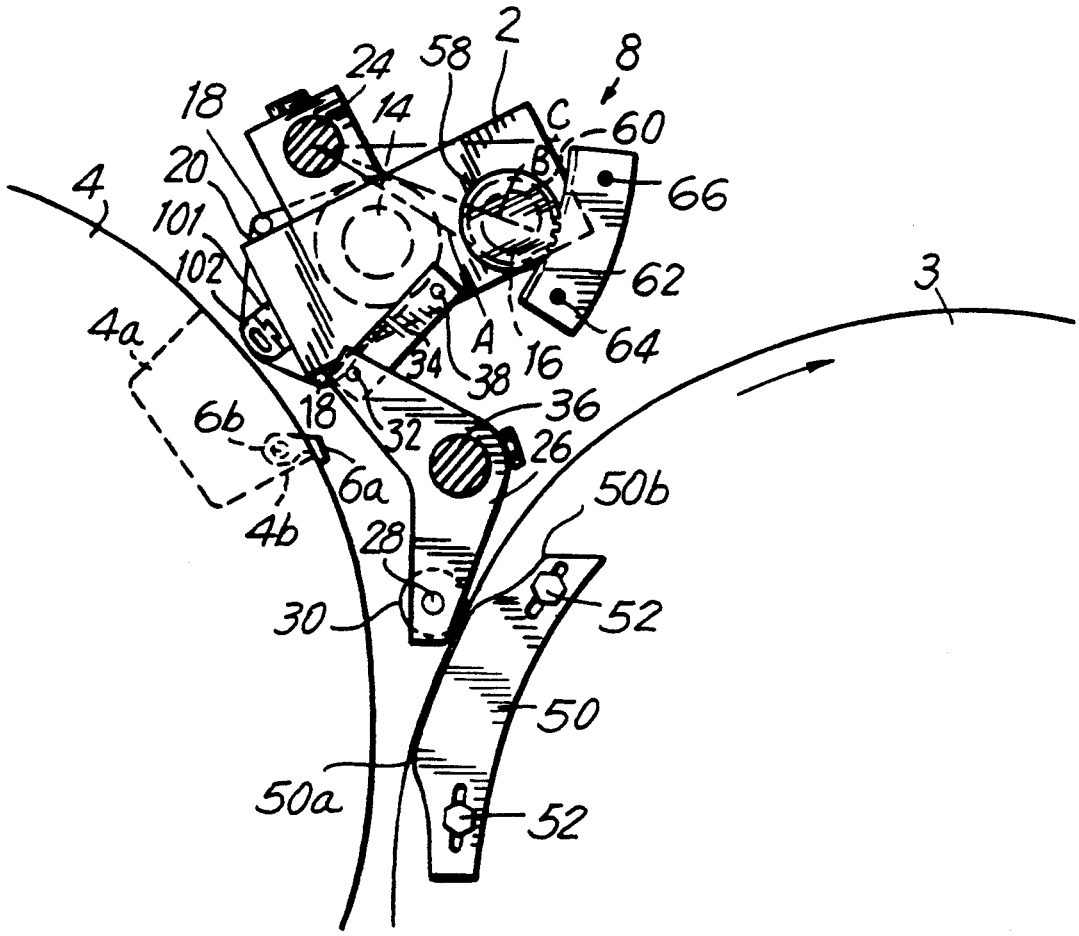
FIG. 5 is a side elevation of the cylinder cleaning mechanism of FIG. 1 with its cylinder cleaning unit at an escape position.

Referring to FIG. 5, when the high cam section 50*a* of the plate cam 50 engages the cam roller 30, the first lever 26 is turned clockwise to retract the cylinder cleaning unit 8 from the cleaning position to the escape position to avoid the collision between the gripping fingers 6*a* and the cylinder cleaning unit 8. At the same time, the rotary shaft 36 is turned clockwise against a torque applied thereto by the pneumatic actuator 107.

Figure 6:
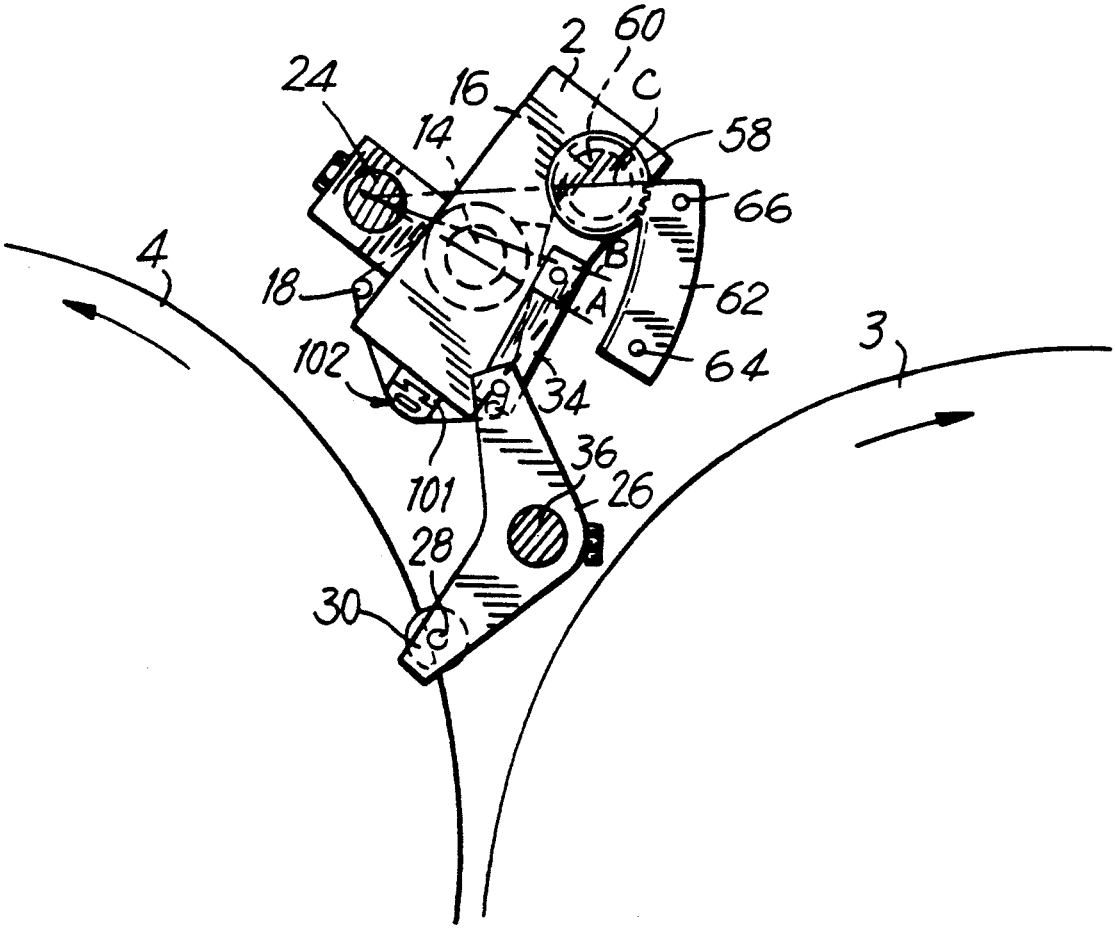
FIG. 6 is a side elevation of the cylinder cleaning mechanism of FIG. 1 with its cylinder cleaning unit at a standby position.
Figure 7:
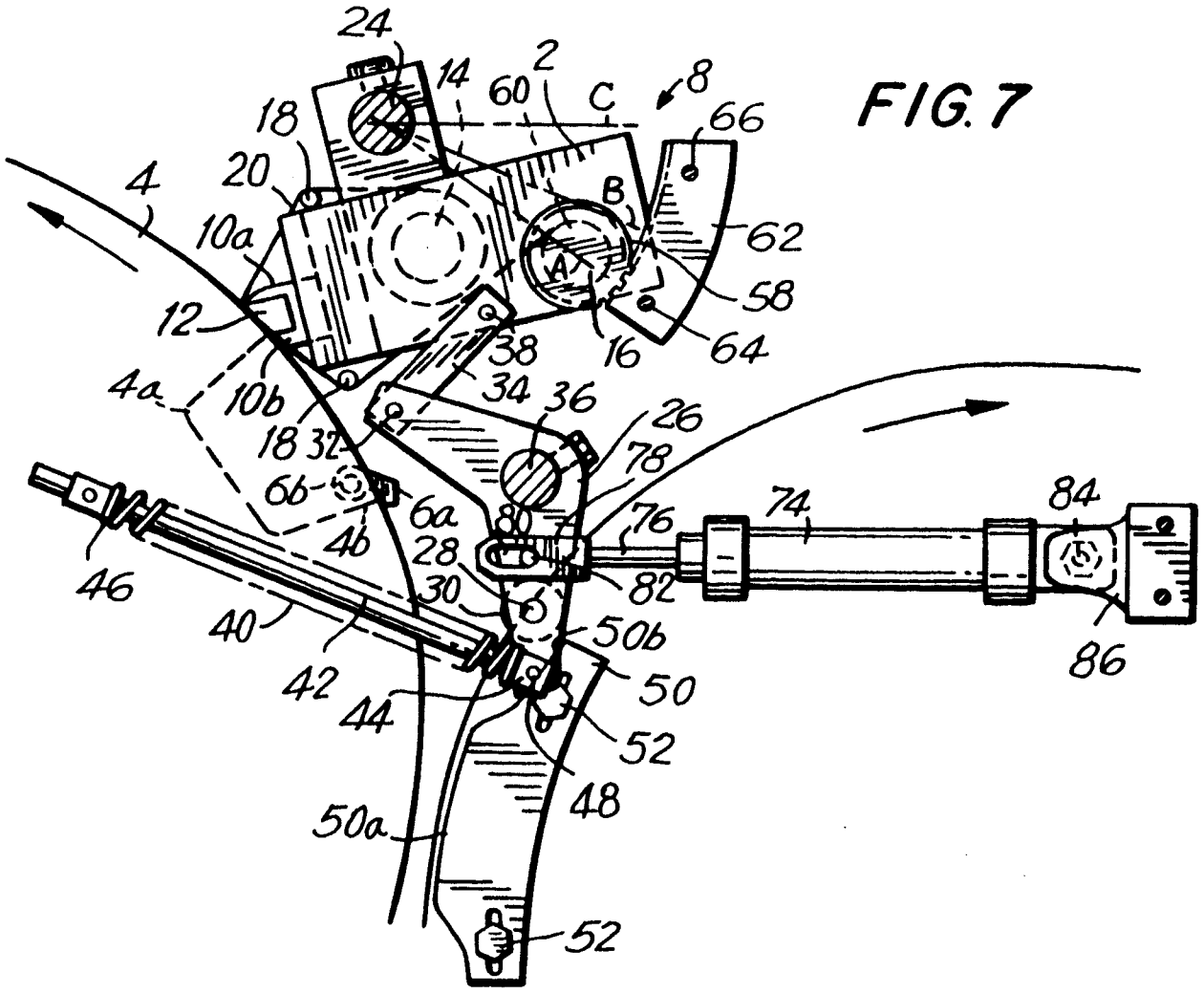
FIG. 7 is a side elevation of a conventional cylinder cleaning mechanism in cleaning operation.
Figure 8:
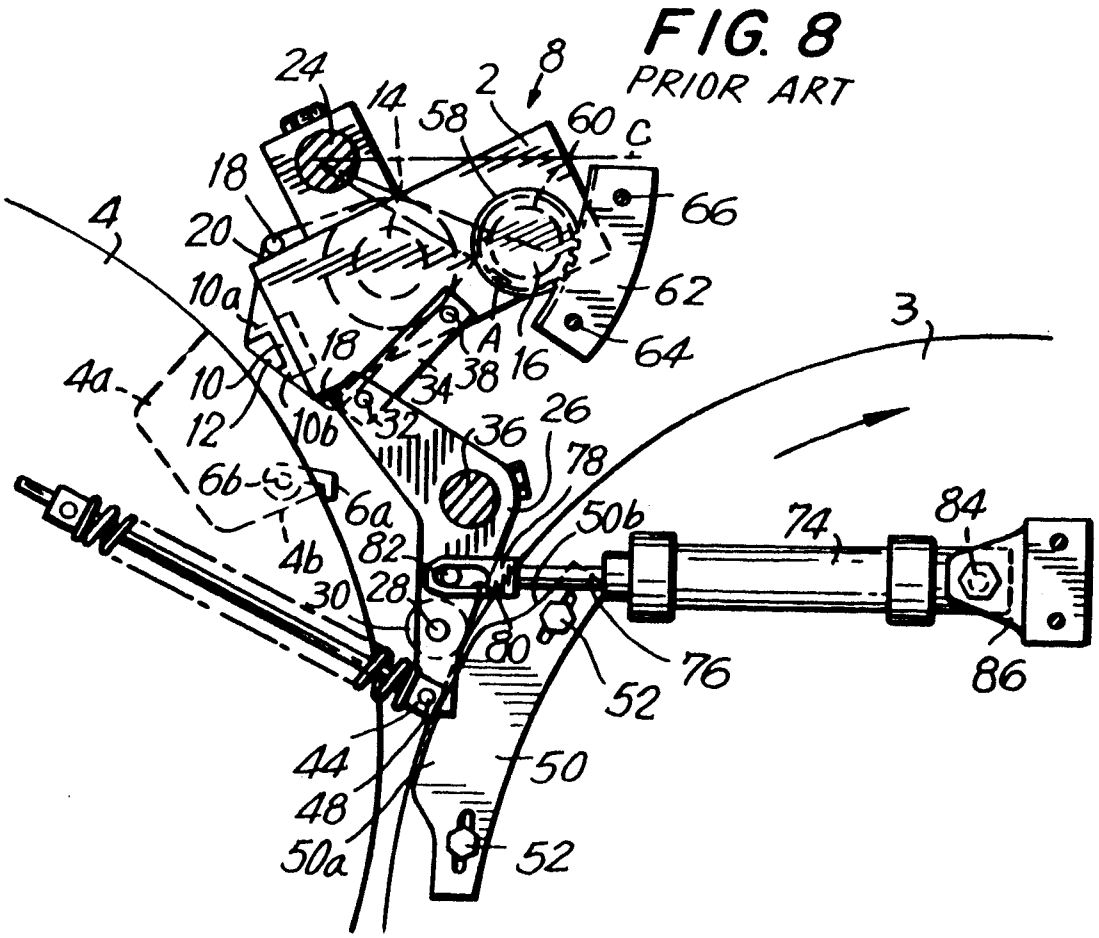
FIG. 8 PRIOR ART
FIG. 8 is a side elevation of the conventional cylinder cleaning mechanism of FIG. 7 with its cylinder cleaning unit retracted from a cleaning position to an escape position during cleaning operation.
Figure 9:
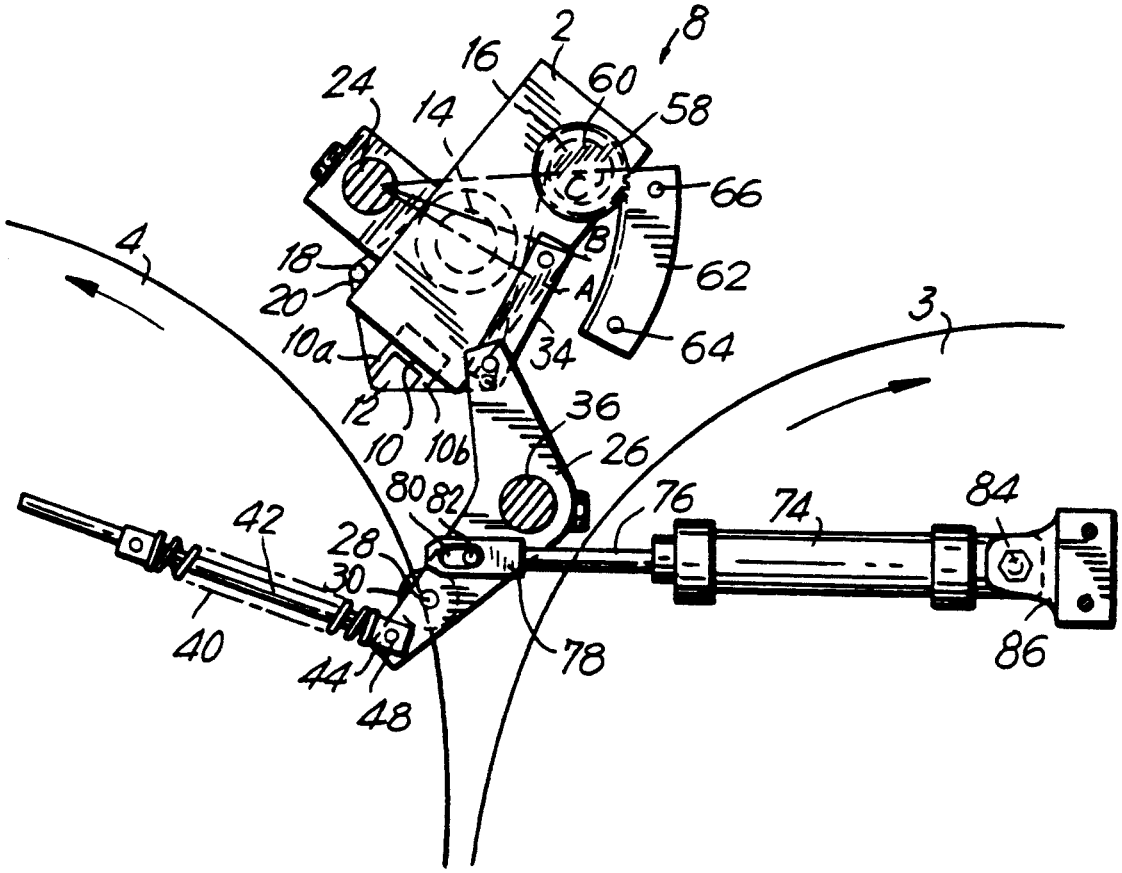
FIG. 9 PRIOR ART
FIG. 9 is a side elevation of the conventional cylinder cleaning mechanism of FIG. 7 with its cylinder cleaning unit located at a standby position.
Figure 10:
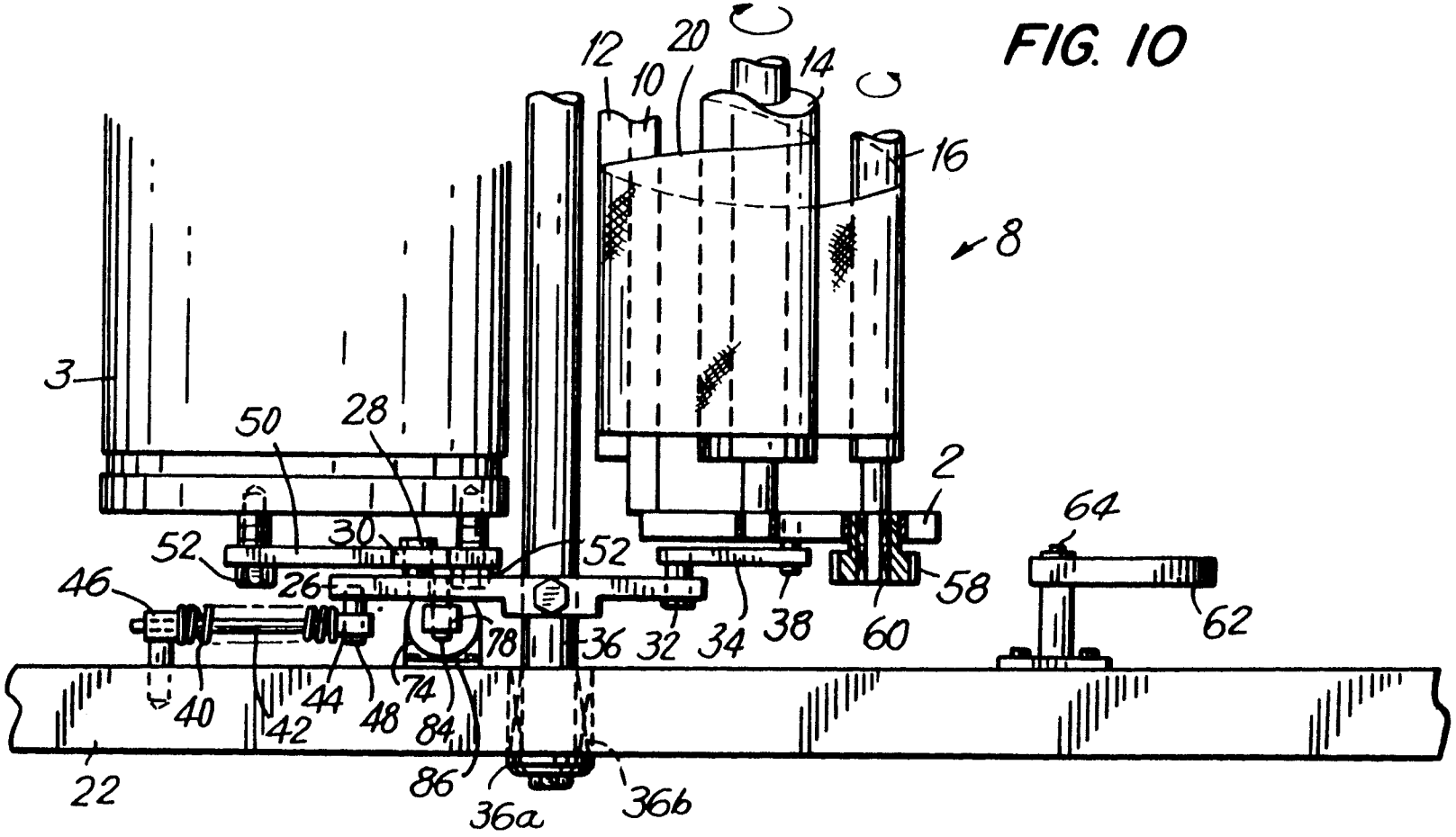
FIG. 10 is a revolved plan view of a portion of the conventional cylinder cleaning mechanism of FIG. 7.
Figure 11:
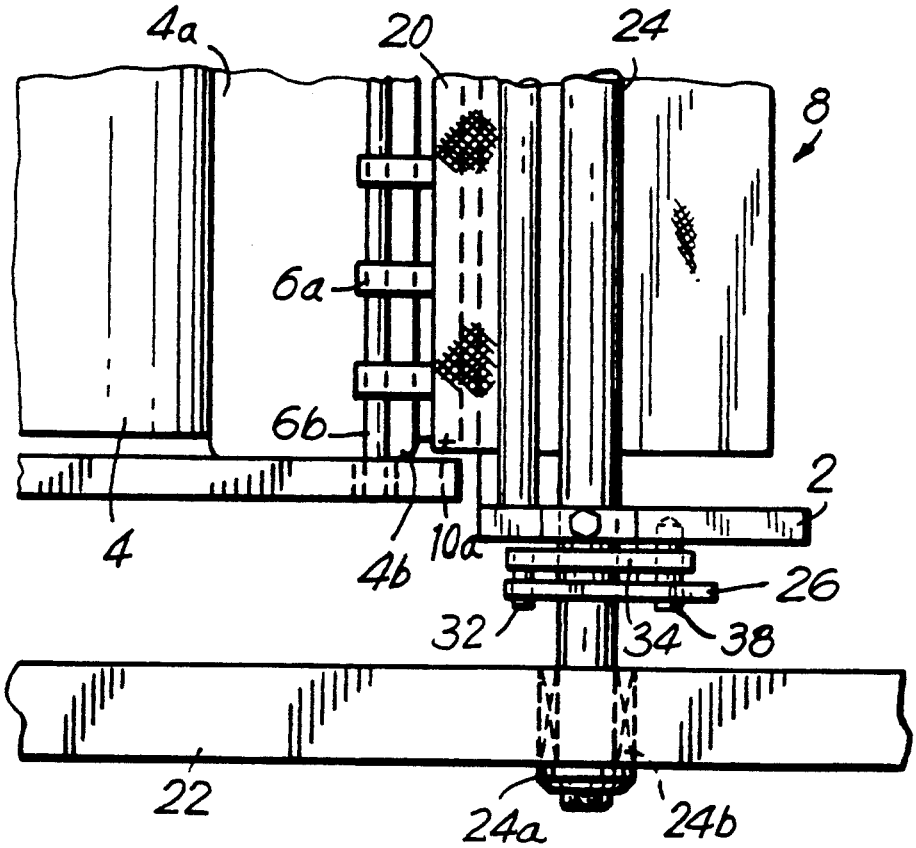
FIG. 11 is a plan view of a portion of the conventional cylinder cleaning mechanism of FIG. 7.

In shifting the cylinder cleaning unit 8 to the standby position, the piston rod 108 of the pneumatic actuator 107 is retracted to turn the second lever 106 counterclockwise, as viewed in FIG. 3, as far as the second lever is stopped by the stopper 110 and, consequently, the first lever 26 is turned clockwise, as viewed in FIG. 6, to shift the cylinder cleaning unit 8 to the standby position as shown in FIG. 6, in which the cleaning cloth 20 is separated far away from the circumference of the impression cylinder 4.

Thus, pneumatic actuator 107 is used both for shifting the cylinder cleaning unit 8 between the cleaning position and the standby position and for pressing the cleaning cloth against the circumference of the impression cylinder 4, which simplifies the cylinder cleaning mechanism, reduces the space necessary for installing the cylinder cleaning mechanism and enables the cleaning cloth 20 to be securely pressed against the circumference of the impression cylinder 4.

Although the present invention has been described as applied to a cylinder cleaning mechanism for cleaning the circumference of the impression cylinder of a printing press, the present invention is applicable also to a cylinder cleaning mechanism for cleaning the circumference of other cylinder of a printing press, such as the blanket cylinder.

While the invention has been shown and described with reference to a preferred embodiment thereof, obviously modifications and variations are possible in the light of above teachings. It is therefore to be understood that the invention may be practiced otherwise than as specifically described herein without departing from the scope and spirit thereof.

What is claimed is:

1. A cylinder cleaning mechanism for cleaning a cylinder of a printing press, including:

a cylinder cleaning unit comprising:

a pair of side plates, a cleaning cloth feed roller journalled on said side plates and operative to feed a cleaning cloth;

a cleaning cloth winding roller journalled on said side plates and operative to wind up cleaning cloth fed by said cleaning cloth feed roller;

a pressure blade held on said side plates, said cleaning cloth extending over said pressure blade for direct engagement of said cleaning cloth with the circumference of said cylinder;

a winding mechanism for rotating said winding roller to wind up used portions of said cleaning cloth sequentially by predetermined lengths;

a mechanism for operating said cylinder cleaning unit in timed relation with rotation of said cylinder, said mechanism including a rise cam rotatable in unison with said cylinder, and a cam follower carried by said cylinder cleaning unit for cooperation with said rise cam, and, for lifting said cylinder cleaning unit away from said cylinder upon engagement of said cam follower by said rise cam; and, means for biasing said cylinder cleaning unit into cleaning engagement with said cylinder, said biasing means comprising a fluid operated actuator directly connected with said cylinder cleaning unit in the absence of lost motion between said fluid operated actuator and said cylinder cleaning unit, said fluid operated actuator being operative to bias said cylinder cleaning unit into engagement with said cylinder exclusively under the influence of fluid pressure supplied to said fluid operated actuator, said cylinder cleaning unit being movable away from said cylinder by said rise cam exclusively against the fluid pressure exerted on said fluid operated actuator, whereby said fluid pressure acts in the function of a vibrationally damped mechanical spring;

said pressure blade has at least one edge portion operative to press said cleaning cloth firmly against said surface of said cylinder in direct engagement therewith, and also has a relatively flexible hollow wiping portion, said hollow wiping portion being located adjacent said pressure blade, and being operative to maintain said cleaning cloth traversing said cylinder in continuous surface engagement with said cylinder throughout the extent of said hollow wiping portion, said hollow wiping portion being conformable under the pressure exerted on said cylinder cleaning unit into an arcuate form contiguous with that of an outer cylindrical surface of said cylinder.

2. A cylinder cleaning mechanism according to claim 1, wherein said fluid-operated actuator shifts the cylinder cleaning unit between a cleaning position where the cleaning cloth is pressed against the circumference of the cylinder of the printing press, and a standby position where the cylinder cleaning unit is separated from the circumference of the cylinder of the printing press.

* * * * *